US006592055B1

(12) United States Patent
Marino

(10) Patent No.: US 6,592,055 B1
(45) Date of Patent: Jul. 15, 2003

(54) SPRINKLER DEVICE HAVING AN INFLATABLE HOOP-SHAPED MANIFOLD FOR CHILDREN TO UTILIZE AS A RECREATIONAL FUN TOY

(76) Inventor: Joseph Marino, 1025 Lovejoy St., Buffalo, NY (US) 14206

( * ) Notice: Subject to any disclaimer, the term of this patent is extended or adjusted under 35 U.S.C. 154(b) by 0 days.

(21) Appl. No.: 10/055,506

(22) Filed: Jan. 22, 2002

(51) Int. Cl.[7] ..... B05B 15/06

(52) U.S. Cl. ..... 239/275; 239/279; 239/567; 4/615

(58) Field of Search ..... 239/289, 273, 239/450, 275, 279, 285, 567; 4/615

(56) References Cited

U.S. PATENT DOCUMENTS 648,263 A 4/1900 Hull
3,170,171 A * 2/1965 Mayhew et al. ..... 4/615
3,363,268 A 1/1968 Friedlander
D277,610 S 2/1985 Arginsky
4,498,627 A 2/1985 Arginsky
4,562,963 A 1/1986 Butler
5,285,968 A 2/1994 McSheehy
5,826,803 A 10/1998 Cooper

* cited by examiner

*Primary Examiner*—Lisa A. Douglas
(74) *Attorney, Agent, or Firm*—Richard L. Miller

(57) ABSTRACT

A free standing sprinkler device having an inflatable hoop-shaped manifold for children to utilize as a recreational fun toy. The inflatable manifold is mechanically removably connected by fluid transmitting coupling components to a base manifold and accordingly expands into a hoop-shape component, responsive to the fluid pressure within, of sufficient size so as to permit persons to step or jump through the hoop-shape component which appropriately sprinkles water therefrom on such persons.

12 Claims, 1 Drawing Sheet

30
18
52
12
10
16
48
14
52
46
28
52
44
42
26
38
22
20
24
26
28
FLUID SOURCE 36

3
10
48
14
46
20
22
12
42
44
40
14
38
24
32
30
28
26
26

22
4
20
50
42
40
4

22
54
20
32
34
24

SPRINKLER DEVICE HAVING AN INFLATABLE HOOP-SHAPED MANIFOLD FOR CHILDREN TO UTILIZE AS A RECREATIONAL FUN TOY

BACKGROUND OF THE INVENTION

1. Field of the Invention

The present invention relates to sprinkler devices to be used primarily for recreational purposes.

2. Description of the Prior Art

Numerous innovations for sprinkler devices have been provided in the prior art that will be described. Even though these innovations may be suitable for the specific individual purposes to which they address, however, they differ from the present invention.

A first example, U.S. Pat. No. 4,562,963 to Butler teaches a garden sprinkler is provided and consists of a hollow tubular frame in an endless closed path that has a first set of inwardly facing apertures along one portion of the frame forming a first spray tube and a second set of inwardly facing apertures along an opposite portion of the frame forming a second spray tube and a device for removably connecting a standard garden hose to the hollow tubular frame. When the hollow tubular frame is placed on a ground surface and water pressure through the garden hose is low the first spray tube and the second spray tube will spray water inside the endless closed path area. When water pressure through the garden hose is high the first spray tube and the second spray tube will overshoot the endless closed path area and spray water to other areas of the ground surface.

A second example, U.S. Pat. No. 5,826,803 to Cooper teaches a lawn and garden sprinkler which has a manifold with one or more bendable tubes extending therefrom. The tubes can be bent to direct one or more streams of water to a desired location. In a preferred design, there is an internal water flow restrictor which permits a larger flow of water from some tubes than others so that a maximum control of water dispersion is obtained. Also, in a preferred configuration, the bendable tubes are made from a flexible material and have a ductile wire within them.

SUMMARY OF THE INVENTION

An object of the present invention is to provide a sprinkler device having an inflatable hoop-shaped manifold for children to utilize as a recreational fun toy that avoids the disadvantages of the prior art.

Another object of the present invention is to provide a sprinkler device having an inflatable hoop-shaped manifold for children to utilize as a recreational fun toy that is simple and inexpensive to manufacture.

Still another object of the present invention is to provide a sprinkler device having an inflatable hoop-shaped manifold for children to utilize as a recreational fun toy that is simple to use.

Briefly stated, still yet another object of the present invention is to provide a free standing sprinkler device having an inflatable hoop-shaped manifold for children to utilized as a recreational fun toy. The inflatable manifold is mechanically removably connected by fluid transmitting coupling components to a base manifold and accordingly expands into a hoop-shape component, responsive to the fluid pressure within, of sufficient size so as to permit persons to step or jump through the hoop-shape component which appropriately sprinkles water therefrom on such persons. When the device is not in use and is disconnected from a fluid source, the hoop-shaped manifold deflates into an amorphous shape convenient for permitting the device to be easily stored.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawings are briefly described as follows.

A MARSHALLING OF REFERENCE NUMERALS UTILIZED IN THE DRAWING

Figure 1:
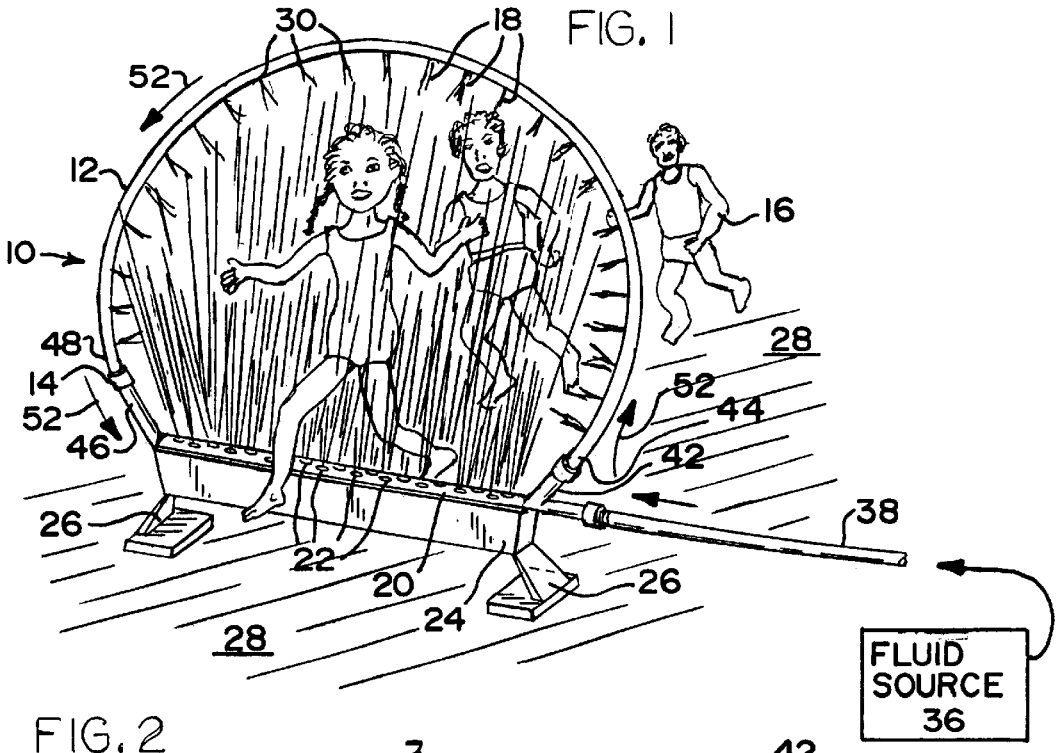
FIG. 1 is a diagrammatic perspective view of the present invention in use.

10 sprinkler device 10 having inflatable hoop-shaped manifold 12
12 inflatable hoop-shaped manifold
14 fluid transmitting coupling components
16 persons
18 water
20 base manifold component
22 spraying orifice
24 stiffening component
26 two legs
28 substantially horizontal surface
30 plurality of spraying orifice
32 pipe
34 surface substantially opposite to where said beam is attached
36 fluid source typically a water hose 38 attached to a bibcock
38 water hose
40 first inlet port
42 first outlet port
44 first end of said semi-flexible manifold component 12
46 second inlet port
48 second end of said semi-flexible manifold component 12
50 plug member
52 path indicated by arrows through the semi-flexible manifold component
54 fluid

DESCRIPTION OF THE PREFERRED EMBODIMENT

Referring now to the figures, in which like numerals indicate like parts, and particularly to FIG. 1, shows a sprinkler device 10 having an inflatable hoop-shaped manifold 12 for children to utilized as a recreational fun toy. The inflatable manifold 12 is mechanically removably connected by fluid transmitting coupling components 14 to a base manifold and accordingly expands into a hoop-shape manifold 12, responsive to the fluid pressure within, of sufficient size so as to permit persons 16 to step or jump through the hoop-shape manifold 12 which appropriately sprinkles water 18 therefrom on such persons 16.

Figure 2:
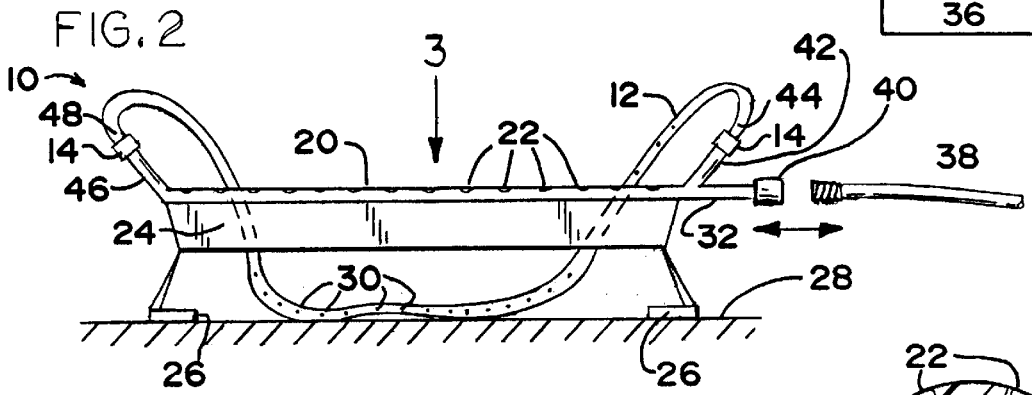
FIG. 2 is a diagrammatic side elevational view illustrating the unit not in use ready to be stowed away.

As best seen in FIGS. 1 and 2, the sprinkler device 10, has a base manifold component 20, having a plurality of spraying orifice 22 formed longitudinally along the length thereof. Also provided is a stiffening component 24 integrally form with said base manifold component, typically having two legs 26 for supporting said base manifold component on a substantially horizontal surface 28 and a semi-flexible manifold component 12 having a plurality of spraying orifice 30, formed longitudinally along the length thereof, in fluid communication with said base manifold 20.

The stiffening component may be such that it is inherent in the nature of the pipe 32 which forms the base manifold component 20, or it may be a separately formed part 24 which is attached or integrally formed as a beam component 24 which is abutted to the base manifold component 20.

Figure 4:
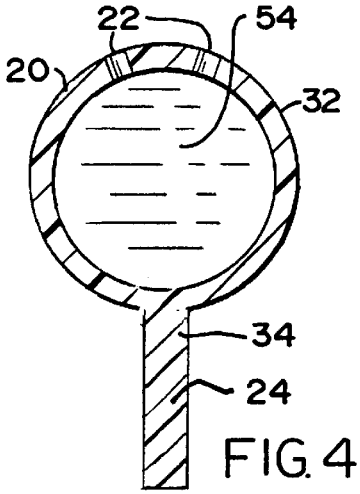
FIG. 4 is an enlarged cross sectional view taken along line 4—4 of FIG. 3.

As best seen in FIG. 4 the beam component may have a substantially rectangular cross section 24 attached to the base manifold component 20 having a circular cross section, wherein the plurality of spraying orifice 20 are formed in a surface 34 substantially opposite to where said beam is attached.

A fluid source 36 typically a water hose attached to a bibcock (not shown) is removably connected to a first inlet port 40 of said base manifold component 20 which is in turn fluidly connected to a first outlet port 42, wherein said first outlet port is connected to a first end 44 of said semi-flexible manifold component 12, and a second inlet port 46 connected to a second end 48 of said semi-flexible manifold component 12.

Figure 3:
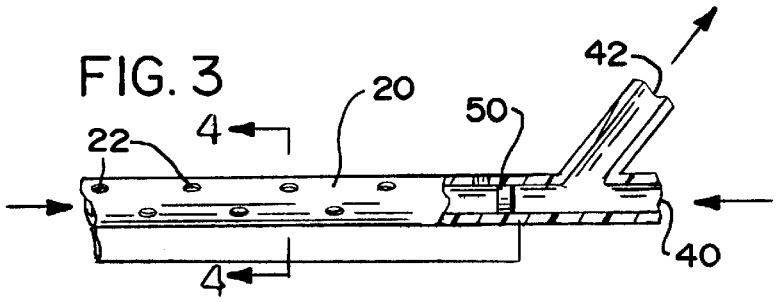
FIG. 3 is an enlarged partial plan view, with parts broken away, of the base manifold of the present invention.

As best seen in FIG. 3 a plug member 50 is permanently installed, utilizing a suitable fastening mechanism, in the base manifold component 20 so as to force fluid 54 which enters the first inlet port 40 to exit first outlet port 42 and follow a path indicated by arrows 52 through the semi-flexible manifold component 12 into second inlet port 46. Accordingly if the pressure in the fluid 54 is sufficient the semi-flexible manifold component 12, expands and assumes a hoop-shape 12 of sufficient size so as to permit persons 16 to step freely through the hoop thus formed. Naturally fluid exits out of the plurality of spraying orifice 22 and 30 creating an appropriate misty area for persons, pets, etc. who wish to cool off on a hot day.

It will be understood that each of the elements described above, or two or more together, may also find a useful application in other types of constructions differing from the types described above.

While the invention has been illustrated and described as embodiments of a sprinkler device having inflatable hoop-shaped manifold for children to utilize as a recreational fun toy, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A sprinkler device for children to utilize as a recreational fun toy which comprises:

a) a base manifold component having a plurality of spraying orifice;

b) a stiffening means integrally formed with said base manifold component;

c) means for supporting said base manifold component on a substantially horizontal surface; and d) a semi-flexible manifold component having a plurality of spraying orifice in fluid communication with said base manifold, wherein said stiffening means is a beam component having a substantially rectangular cross section attached to said manifold having a circular cross section, wherein said plurality of spraying orifice are formed in a surface substantially opposite to where said beam is attached.

2. The sprinkler device as defined in claim 1, wherein means for supporting said base manifold component on a substantially horizontal surface are two support legs each attached to an opposite end of said base manifold component.

3. The sprinkler device as defined in claim 1, wherein said plurality of spraying orifice are formed at intervals along a longitudinal length of said base manifold component.

4. The sprinkler device as defined in claim 1, wherein said plurality of spraying orifice are formed at intervals along a longitudinal length of said semi-flexible manifold component.

5. The sprinkler device as defined in claim 1, wherein means for supporting said base manifold component on a substantially horizontal surface is at least one support leg attached to said base manifold component.

6. A sprinkler device for children to utilize as a recreational fun toy which comprises:

a) a base manifold component having a plurality of spraying orifice, which are formed at intervals along a longitudinal length of said base manifold component;

b) a stiffening means integrally formed with said base manifold component, wherein said stiffening means is a beam component having a substantially rectangular cross section attached to said manifold having a circular cross section, wherein said plurality of spraying orifice are formed in a surface substantially opposite to where said beam is attached;

c) means for supporting said base manifold component on a substantially horizontal surface; and d) a semi-flexible manifold component having a plurality of spraying orifice in fluid communication with said base manifold, which are formed at intervals along a longitudinal length of said semi-flexible manifold component;

wherein means for supporting said base manifold component on a substantially horizontal surface are two support legs each attached to an opposite end of said base manifold component;

wherein said base manifold component has, a first inlet port fluidly connected to a first outlet port;

wherein said first outlet port is connected to a first end of said semi-flexible manifold component, and a second inlet port connected to a second end of said semi-flexible manifold component;

wherein a plug member is installed, in said base manifold component so as to force fluid which enters said first inlet port to exit said first outlet port and follow a path through said semi-flexible manifold component into said second inlet port, so that said semi-flexible manifold component, expands and assumes a hoop-shape.

7. A sprinkler device for children to utilize as a recreational fun toy which comprises:

a) a base manifold component having a plurality of spraying orifice;

b) a stiffening means integrally formed with said base manifold component;

c) means for supporting said base manifold component on a substantially horizontal surface; and d) a semi-flexible manifold component having a plurality of spraying orifice in fluid communication with said base manifold, wherein said base manifold component has, a first inlet port fluidly connected to a first outlet port, wherein said first outlet port is connected to a first end of said semi-flexible manifold component, and a second inlet port connected to a second end of said semi-flexible manifold component.

8. The sprinkler device as defined in claim 7, wherein a plug member is installed, in the base manifold component so as to force fluid which enters said first inlet port to exit said first outlet port and follow a path through said semi-flexible manifold component into said second inlet port, so that said semi-flexible manifold component, expands and assumes a hoop-shape.

9. The sprinkler device as defined in claim 7, wherein means for supporting said base manifold component on a substantially horizontal surface are two support legs each attached to an opposite end of said base manifold component.

10. The sprinkler device as defined in claim 7, wherein said plurality of spraying orifice are formed at intervals along a longitudinal length of said base manifold component.

11. The sprinkler device as defined in claim 7, wherein said plurality of spraying orifice are formed at intervals along a longitudinal length of said semi-flexible manifold component.

12. The sprinkler device as defined in claim 7, wherein means for supporting said base manifold component on a substantially horizontal surface is at least one support leg attached to said base manifold component.

* * * * *